US007331331B2

(12) United States Patent
Hanawa et al.

(10) Patent No.: US 7,331,331 B2
(45) Date of Patent: Feb. 19, 2008

(54) FUEL INJECTION VALVE INSTALLATION STRUCTURE OF ENGINE

(75) Inventors: Kaoru Hanawa, Saitama (JP); Satoru Shimizu, Saitama (JP)

(73) Assignee: Honda Motor Co., Ltd, Tokyo (JP)

( * ) Notice: Subject to any disclaimer, the term of this patent is extended or adjusted under 35 U.S.C. 154(b) by 0 days.

(21) Appl. No.: 11/657,099

(22) Filed: Jan. 24, 2007

(65) Prior Publication Data

US 2007/0169755 A1 Jul. 26, 2007

(30) Foreign Application Priority Data

Jan. 25, 2006 (JP) ..... 2006-016883

(51) Int. Cl.
*F02M 61/18* (2006.01)
*F02M 61/14* (2006.01)

(52) U.S. Cl. ..... 123/470; 123/531; 123/533

(58) Field of Classification Search ..... 123/470, 123/468, 469, 467, 525, 531, 533
See application file for complete search history.

(56) References Cited

U.S. PATENT DOCUMENTS 6,481,421 B1 * 11/2002 Reiter ..... 123/470
6,543,421 B2 * 4/2003 Lorraine et al. ..... 123/470
2004/0040543 A1 * 3/2004 Mickelson ..... 123/470
2004/0089270 A1 * 5/2004 Scheffel ..... 123/470
2004/0112339 A1 * 6/2004 Berger et al. ..... 123/468

FOREIGN PATENT DOCUMENTS

DE 10 2004 053 040 A1 5/2006
EP 1 262 652 A2 12/2002
JP 2004-116447 A 4/2004
WO WO-2006/097374 A1 9/2006

* cited by examiner

*Primary Examiner*—Mahmoud Gimie
(74) *Attorney, Agent, or Firm*—Birch, Stewart, Kolasch & Birch, LLP

(57) ABSTRACT

To effectively reduce operational noise generated by vibration of the fuel injection valve with a fuel injection valve installation structure of an engine. In the structure, an installation hole is formed in an engine component member that constitutes a part of an engine. The installation hole has an annular shoulder portion, which is formed in the middle portion thereof, and which faces the exterior side. The fuel injection valve is held between the annular shoulder portion and a supporting member attached to the engine component member. A first damper, with high vibration-damping properties, is set between an annular shoulder portion and a fuel injection valve. A second damper, with high vibration-damping quality, is set between a supporting member and the fuel injection valve.

20 Claims, 3 Drawing Sheets

FUEL INJECTION VALVE INSTALLATION STRUCTURE OF ENGINE

CROSS-REFERENCE TO RELATED APPLICATIONS

The present application claims priority under 35 USC 119 to Japanese Patent Application No. 2006-016883 filed on Jan. 25, 2006 the entire contents of which are hereby incorporated by reference.

BACKGROUND OF THE INVENTION

1. Field of the Invention

The present invention relates to a fuel injection valve installation structure of an engine. In the fuel injection valve installation structure, an installation hole is formed in an engine component member that constitutes a part of an engine. The installation hole has an annular shoulder portion, which is formed in the middle portion thereof, and which faces the exterior side. The fuel injection valve is held between the annular shoulder portion and a supporting member attached to the engine component member.

2. Description of Background Art

A type of four-cycle direct injection engine is disclosed in, for example, Japanese Patent Application Laid-Open No. 2004-116447. The type of engine has an installation hole formed in a cylinder head. An air injector as a fuel injection valve is held between a supporting member attached to the cylinder head and an annular shoulder portion formed in the middle portion of the installation hole.

In the structure disclosed in Japanese Patent Application Laid-Open No. 2004-116447, the air injector is directly held between the cylinder head and a head cover. Thus, the vibration produced at the time of injection is emitted from the engine body to the outside. When an engine is mounted on a vehicle, some kind of countermeasure, such as a sound insulation cover is needed to deal with the emitted noise. More particularly, with regard to a motorcycle, such a sound insulation cover directly affects the appearance, and also affects the cooling capability of the engine itself. These problems must be taken care of. As a result, the structure becomes more complex, and the cost becomes higher.

SUMMARY AND OBJECTS OF THE INVENTION

The present invention has been made under these circumstances. An object of an embodiment of the present invention is to provide a fuel injection valve installation structure of an engine, which can effectively reduce the operational noise due to the vibration of the fuel injection valve.

In order to accomplish an object of an embodiment of the present invention the fuel injection valve installation structure of an engine has an installation hole formed in an engine component member that constitutes a part of an engine. The installation hole has an annular shoulder portion, which is formed in the middle portion thereof, and which faces the exterior side. The fuel injection valve is held between the annular shoulder portion and a supporting member attached to the engine component member. In the fuel injection valve installation structure, a first damper means with a high vibration damping property is set between the annular shoulder portion and the fuel injection valve. In addition, a second damper means with a high vibration damping property is set between the supporting member and the fuel injection valve.

An object of an embodiment of the present invention provides a second damper means that includes a damper holder and a damper member. The damper holder is brought into contact with the fuel injection valve from the exterior side of the installation hole, and is slidably supported by the damper cover in the axial directions of the installation hole. The damper member is held by the damper holder, and is set between the damper holder and the supporting member. A sliding member is attached to the supporting member, and guides the sliding movement of the damper holder in the axial directions of the installation hole against the supporting member.

An object of an embodiment of the present invention provides a first damper means that is formed by stacking two kinds of damper member, each one of which has a different vibration-damping property from that of the other.

An object of an embodiment of the present invention provides at least a part of the damper member that the second damper means has that is made of a rubber, and the first damper means has a wave washer with a spring force being set lower than that of the rubber.

An object of an embodiment of the present invention provides a fuel injection valve that is an air injector that is arranged to be slidably fitted into a valve-holding member, which is located at a fixed position to the engine component member. The rear end of the fuel injection valve is communicated with a pressurized air chamber that is formed in the valve-holding member.

An object of an embodiment of the present invention provides an engine component member that is a cylinder head.

Note that, a damper cover 46 in an embodiment below corresponds to the supporting member of an embodiment of the invention. In addition, a damping washer 49 and a wave washer 50 in the embodiment below correspond to the damper member according to an embodiment of the present invention.

According to an embodiment of the present invention, the fuel injection valve is floatingly supported, by the first and the second damper means, between the engine component member and the supporting member. As a result, the first and the second damper means curb the vibration generated in the fuel injection valve that may otherwise be emitted out from the engine component member. In addition, the operation noise due to the vibration of the fuel injection valve can be effectively reduced.

According to an embodiment of the present invention, the sliding member facilitates a smooth sliding movement of the damper holder in the axial directions of the installation hole. Thus, the damper member exhibits an improved vibration-absorbing performance. As a result, the operation noise can be reduced more effectively.

According to an embodiment of the present invention, the first damper means is formed by stacking two vibration-damping members, each of which has a vibration-damping property different from that of the other. As a result, the operation noise can be reduced more effectively.

According to an embodiment of the present invention, the set load of the wave washer can be adjusted by adjusting the thickness of the rubber that constitutes a part of the second damper means. The wave washer, with its contraction, absorbs the return vibration generated when the fuel injection valve returns to the annular shoulder portion side of the installation hole. As a result, the vibration transmitted to the engine component member can be effectively absorbed.

According to an embodiment of the present invention, while making the assembling operation easier, the noise related to the injection operation of the fuel injection valve and the accompanying pressure change in the pressurized air chamber, can be reduced.

According to an embodiment of the present invention, the two stacked vibration-damping members effectively blocks the transfer of heat from the cylinder head to the fuel injection valve side. As a result, the temperature rise of the fuel injection valve can be curbed.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

A mode for carrying out the present invention will be explained below, according to an embodiment of the present invention shown in the accompanying drawings.

Figure 1:
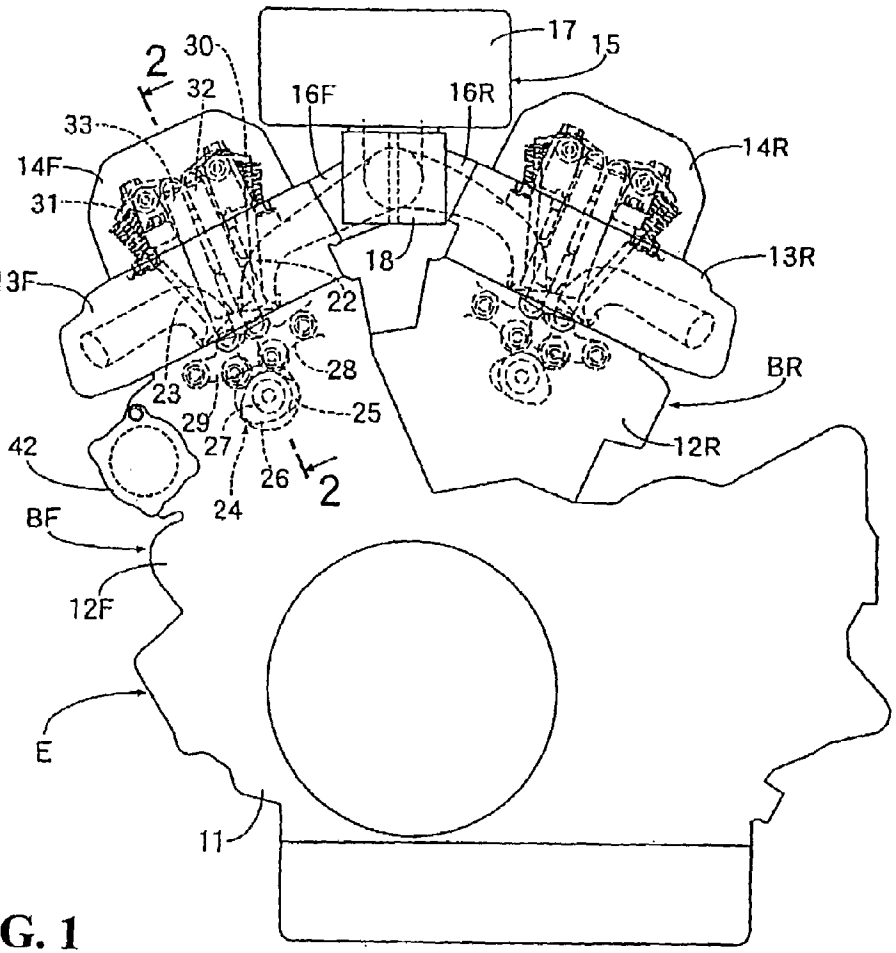
FIG. 1 is a side view of an engine.
Figure 2:
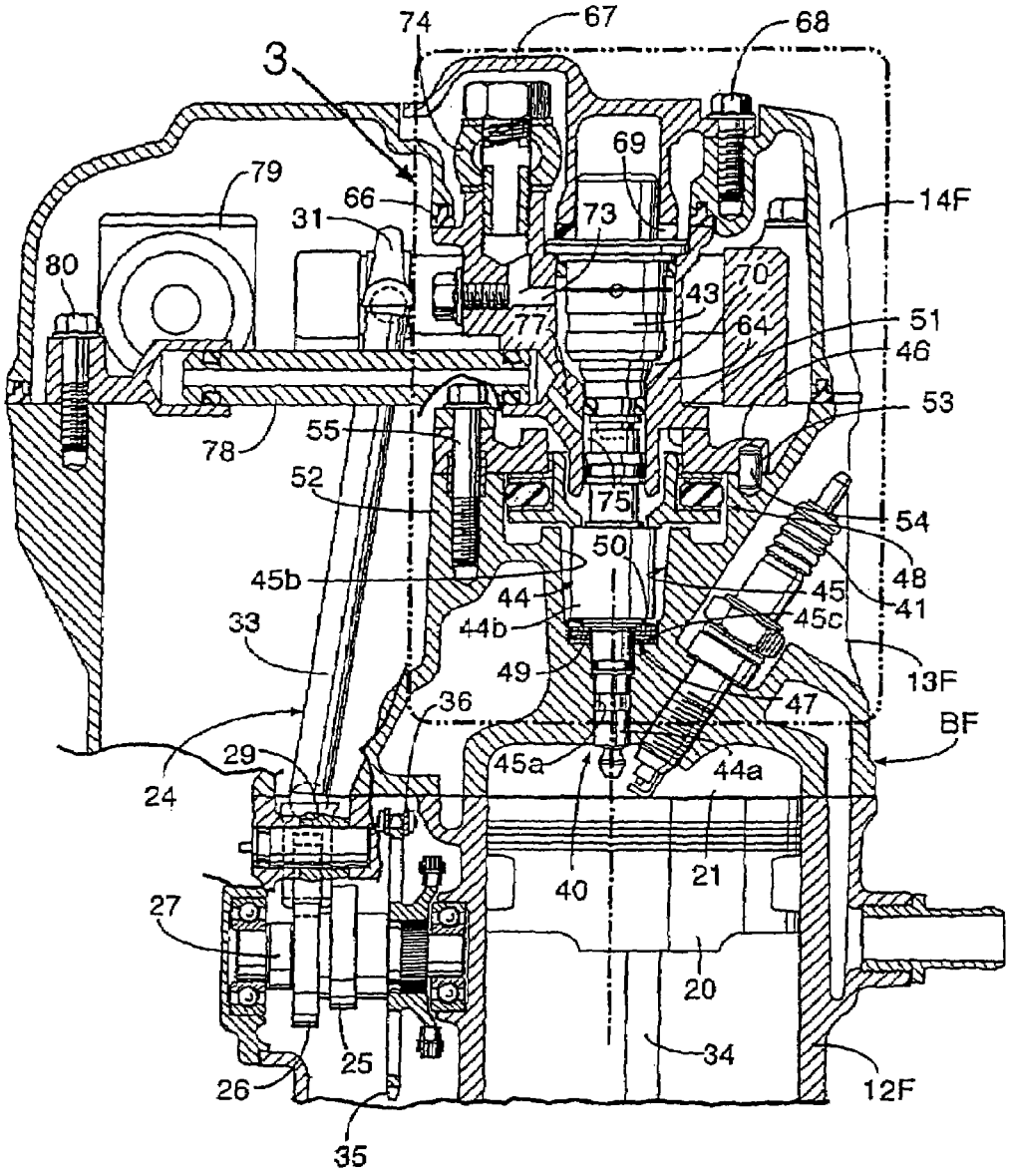
FIG. 2 is a sectional view taken along line 2-2 of FIG. 1.
Figure 3:
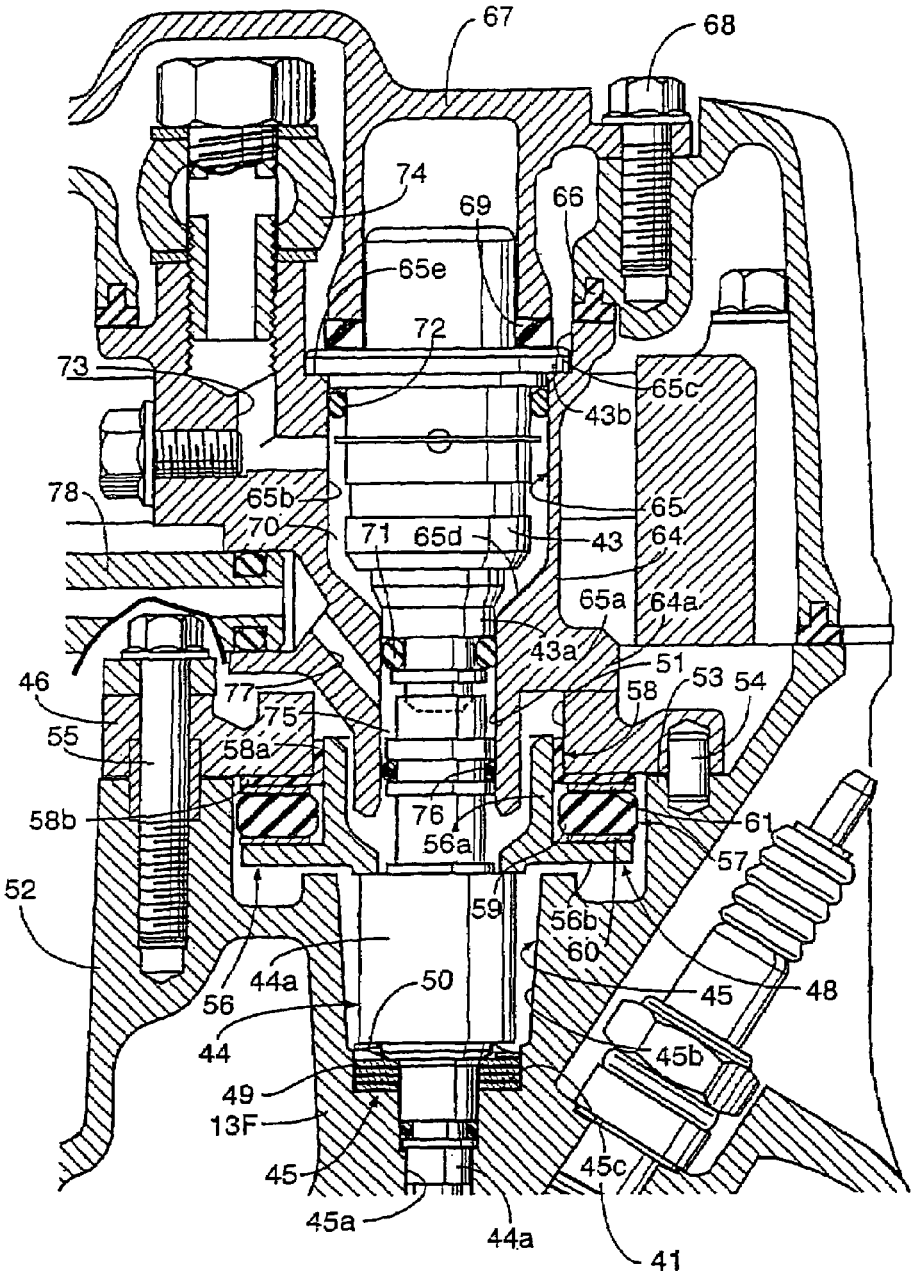
FIG. 3 is an enlarged view of a portion indicated by arrow 3 in FIG. 2.

FIGS. 1 to 3 show an embodiment of the present invention. As illustrated in FIG. 1, an engine E is a four-cycle direct injection engine, which is mounted, for example, on a motor cycle. The engine E is a V-type engine that includes a front bank BF and a rear bank BR, each of which is configured as a single cylinder.

The front bank BF and the rear bank BR are configured by cylinder blocks 12F and 12R, respectively. The cylinder blocks 12F and 12R are fixed to a common crankcase 11 to form, substantially, a V-shape. The front and the rear banks BF and BR also have, respectively, cylinder heads 13F and 13R which are fixed to the respective upper portions of cylinder blocks 12F and 12R. In addition, the front and the rear banks BF and BR have head covers 14F and 14R, which are fixed to the respective upper portions of cylinder heads 13F and 13R.

An intake system 15 is provided between the two banks BF and BR. The intake system 15 is configured of intake pipes 16F and 16R, which are connected, respectively, to the inner side surfaces of the cylinder heads 13F and 13R in the two corresponding banks BF and BR. The intake system 15 also has an air cleaner 17 and a throttle body 18. The throttle body 18 is provided between the air cleaner 17, and the two intake pipes 16F and 16R so that the flow of the intake air in the intake pipes can be controlled.

Now, explanations are given by referring also to FIG. 2. In the front bank BF, a combustion chamber 21 is formed between the cylinder block 12F and the cylinder head 13F. A piston 20 is fitted into the cylinder block 12F so that the piston 20 can freely slide. The head of the piston 20 faces the combustion chamber 21. An intake valve 22 and an exhaust valve 23, both of which can be opened and shut, that are provided to the cylinder head 13F (see FIG. 1). The intake valve 22 controls the air flowing from the intake pipe 16F into the combustion chamber 21, while the exhaust valve 23 controls the exhaust gas discharged from the combustion chamber 21.

A valve system 24 is driven to open and shut the intake and the exhaust valves 22 and 23. The valve system 24 includes a cam shaft 27, a first intake rocker arm 28, a first exhaust rocker arm 29, a second intake rocker arm 30, a second exhaust rocker arm 31, a driving rod on the intake side 32, and a driving rod on the exhaust side 33. The cam shaft 27 has an intake cam 25 and an exhaust cam 26. The cam shaft 27 is supported by the cylinder block 12F so that the shaft can freely rotate. The first intake rocker arm 28 swings while being driven by the intake cam 25. The first exhaust rocker arm 29 swings while being driven by the exhaust cam 26. The second intake rocker arm 30 works together and is connected to the intake valve 22. The second exhaust rocker arm 31 works together with and is connected to the exhaust valve 23. The driving rod on the intake side 32 is provided between the first and the second intake rocker arms 28 and 30. The driving rod 32 transmits the swinging motion of the first arm 28 to the second arm 30. The driving rod on the exhaust side 33 is provided between the first and the second exhaust rocker arms 29 and 31. The driving rod 33 transmits the swinging motion of the first arm 29 to the second arm 31.

The cam shaft 27 is supported, at its two ends, by the cylinder block 12F as being capable of rotating freely. A connecting rod 34 links the cam shaft 27 to the piston 20. The torque of a crankshaft (not illustrated), which is supported by the crankcase 11 as being capable of freely rotating, is transmitted to the cam shaft 27. During the transmission process, the rotational speed of the crankshaft 11 is reduced to half with a driven sprocket 35, a drive sprocket, and an endless cam chain 36. The driven sprocket 35 is mounted on the cam shaft 27 as being incapable of rotating relatively to the shaft 27. The drive sprocket is fixed to the crankshaft. The cam chain 36 is looped around the driven sprocket and the drive sprocket.

The combustion chamber 21 has an injector 40. The injector 40 is provided in the cylinder head 13F between the intake and the exhaust valves 22 and 23. The injector 40 has an axis parallel to the operational axis of the piston 20, and injects the fuel directly into the combustion chamber 21. A spark plug 41 is mounted in the cylinder head 13F to ignite the fuel injected into the combustion chamber 21, while the tip end of the plug 41 projects into the chamber 21.

Compressed air is supplied to the injector 40 by an air compressor 42 fixed, on the front side, to the front side wall of the cylinder block 12F. The air compressor 42 is driven by the driving force which is transmitted from the crankshaft.

A fuel injector 43 and an air injector 44 constitute the injector 40, while these injectors 43 and 44 are coaxially connected to each other. The fuel injector 43 is installed into the head cover 14F for the purpose of injecting the fuel. The air injector 44 is installed into the cylinder head 13F as an engine component member for the purpose of injecting the fuel as well as the compressed air directly into the combustion chamber 21. The air injector 44 has a nozzle 44*a*, which plunges into the combustion chamber 21, at a first of the two end portions. The air injector 44 also has a large-diameter portion 44*b* in the middle portion in the axial directions.

In the cylinder head 13F, an installation hole 45 is formed to be in parallel to the operational axis of the piston 20. The installation hole 45 has a small-diameter-hole portion 45*a* and a large-diameter-hole portion 45*b*. An opening to the combustion chamber 21 is provided at a first of the two ends of the small-diameter-hole portion 45*a*. The large-diameter-hole portion 45*b* is formed with a diameter larger than that of the small-diameter-hole portion 45*a*, and a first end of the large-diameter-hole portion 45*b* coaxially adjoins the second end of the small-diameter-hole portion 45*a*. As a result, an annular shoulder portion 45*c*, facing the exterior side, is formed between the second end of the small-diameter-hole portion 45*a* and the large-diameter portion 45*b*. The air injector 44 is inserted into the installation hole 45 from the exterior side, that is, from the head cover 14F side, to make the nozzle 44*a* at the first end side to be hermetically fitted into the small-diameter-hole portion 45*a*. Thus, the large-diameter portion 44*b*, which the air injector 44 has in the middle portion thereof in the axial directions, is placed in the large-diameter-hole portion 45*b* of the installation hole 45.

The air injector 44 is held between the annular shoulder portion 45*c* and a damper cover 46, which is a supporting member attached to the cylinder head 13F. A first damper means 47, with a high vibration-damping property, is set between the annular shoulder portion 45*c* and the air injector 44. A second damper means 48, with a high vibration-damping property, is set between the damper cover 46 and the air injector 44.

Now, an explanation is given by referring to FIG. 3, wherein the first damper means 47 is formed by stacking two kinds of damper members, each of which has a different vibration-damping property from that of the other, one on the top of the other. In this embodiment, a plurality of damping washers 49 and a wave washer 50 are stacked. Each damping washer 49, here four damping washers 49 being stacked, is made of a damping steel sheet or a damping alloy. The first damper means 47 is set between the annular shoulder portion 45*c* and the bottom end of the large-diameter portion 44*b* of the air injector 44.

The damper cover 46 is formed in a ring shape with a center hole 51 formed, in the center portion, concentrically with the installation hole 45. Bosses 52 . . . and another boss 53 are provided on the cylinder head 13F around the installation hole 45. The bosses 52 . . . and 53 project at a plurality of positions, for example, four positions, at intervals in a circumferential direction. A positioning pin 54 is used to determine the position of the damper cover 46 to the boss 53, and then the damper cover 46 is fastened to the bosses 52 . . . with bolts 55 . . . .

The second damper means 48 has a damper holder 56 and a damper member 57. The damper holder 56 is brought into contact with the air injector 44 from the exterior side of the installation hole 45, and is slidably supported by the damper cover 46 in the axial directions of the installation hole 45. The damper member 57 is held by the damper holder 56, and is set between the damper holder 56 and the damper cover 46. A collar 58 is attached to the damper cover 46, and is a sliding member to guide the sliding movement of the damper holder 56, in the axial directions of the installation hole 45, against the damper cover 46.

The damper holder 56 has a cylinder portion 56*a* and a brim portion 56*b*, and is made, for example, from a vibration damping steel. The bottom portion of the cylinder portion 56*a* is brought into contact with the top end of the large-diameter portion 44*b* of the air injector 44, and the upper portion of the cylinder portion 56*a* is inserted into the center hole 51 of the damper cover 46. The brim portion 56*b* sticks out radially from the lower portion of the cylinder portion 56*a*. A ring-shaped rubber 59 and ring-shaped washers 60 and 61 constitute the damper member 57. The rubber 59, which is surrounding the cylinder portion 56*a* of the damper holder 56, is placed between and thermally bonded to the washers 60 and 61, which are made, for example, of iron. The spring force of the wave washer 50, included in the first damper means 47, is set to be lower than that of the rubber 59.

The collar 58 is made, for example, of fluorine resin. A cylinder portion 58*a* and a brim portion 58*b* are integrated into the collar 58. The cylinder portion 58*a* is inserted into the center hole 51 of the damper cover 46, and is set between the cylinder portion 56*a* of the damper holder 56 and the damper cover 46. The brim portion 58*a* sticks out radially from the bottom end of the cylinder portion 58*a*, and is brought into contact with the under surface of the damper cover 46. The damper member 57 is placed between the brim portion 56*b* of the damper holder 56 and the collar 58. More specifically, the brim portion 58*b* thereof, which is in contact with the damper cover 46.

A second end portion of the air injector 44 is, hermetically and slidably, fitted into an injector holder 64, which is a valve-holding member located at a fixed position to the cylinder head 13F. A retaining hole 65, coaxial with the installation hole 45, is provided in the injector holder 64. The second end portion of the air injector 44 is, hermetically and slidably, fitted into a small-diameter-hole portion 65*a* of the injector holder 64. The small-diameter-hole portion 65*a*, an intermediate-diameter-hole portion 65*b* with a larger diameter than that of the small-diameter-hole portion 65*a*, and a large-diameter hole portion 65*c* with a larger diameter than that of the intermediate-diameter-hole portion 65*b* are coaxially and successively provided from the bottom up to form the retaining hole 65. A tapered shoulder portion 65*d* is formed between the small-diameter-hole portion 65*a* and the intermediate-diameter-hole portion 65*b*. An annular shoulder portion 65*e*, facing the exterior side, is formed between the intermediate-diameter-hole portion 65*b* and the large-diameter-hole portion 65*c*.

The injector holder 64 has a plurality of supporting leg portions 64*a*, which are integrated into the lower part of the injector holder 64. The supporting leg portions 64*a* are brought into contact with the top of the damper cover 46. The head cover 14F is brought into contact with the upper portion of the injector holder 64 with a gasket 66 placed in between. In other words, the injector holder 64 is held between the head cover 14F and the damper cover 46, attached to the cylinder head 13F.

The fuel injector 43, which is inserted into the retaining hole 65, has a nozzle portion 43*a* at a first end thereof and a brim portion 43*b* near a second end thereof. The tip end portion of the nozzle portion 43*a* is inserted into the second end of the air injector 44, so that the nozzle portion 43*a* is hermetically fitted into the small-diameter-hole portion 65*a* of the retaining hole 65. In addition, a cover 67, which covers the fuel injector 43 from above, is fastened to the head cover 14F with a plurality of bolts 68 . . . . The cover 67 is brought into contact with the brim portion 43*b* of the fuel injector 43 from above with a gasket 69 placed in between. Accordingly, the fuel injector 43 is held between the annular shoulder portion 65*e* of the injector holder 64, which is located at a fixed position to the cylinder head 13F, and the cover 67, which is fastened to the head cover 14F.

An annular fuel chamber 70 is formed between the injector holder 64 and the fuel injector 43, and the fuel chamber 70 leads to inside the fuel injector 43. Ring shaped seal members 71 and 72 seal the fuel chamber 70 on the two axial sides thereof. The seal member 71 is attached to the outer circumference of the nozzle portion 43*a*, and is brought into contact with the inner circumference of the small-diameter-hole portion 65*a* by a spring force of the retaining hole 65. The seal member 72 is attached to the outer circumference of the fuel injector 43, and is brought into contact with the inner circumference of the intermediate-diameter-hole portion 65*b* by a spring force of the retaining hole 65.

In addition, a fuel supply route 73 is formed in the injector holder 64. The fuel supply route 73 leads to the fuel chamber 70, and a hose is connected to the fuel supply route 73 with a joint 74 placed in between. With the hose, the fuel in an unillustrated fuel supply source is channeled into the fuel supply route 73.

A pressurized air chamber 75 is formed in the injector holder 64 and between the tip end portion of the fuel injector 43 and the rear end portion of the air injector 44. The second end, that is, the rear end, of the air injector 44 is in communication with the pressurized air chamber 75. The seal member 71 attached to the nozzle portion 43*a*, and a ring-shaped seal member 76 seal the pressurized air chamber 75 on the two axial sides thereof. The seal member 76 is attached to the outer circumference of the air injector 44 near the second end thereof, and is brought into contact with the inner circumference of the small-diameter-hole portion 65*a* of the retaining hole 65 by a spring force.

A pressurized air route 77, which leads to the pressurized air chamber 75, is provided in the injector holder 64. As is shown in FIG. 2, a regulator 79 is attached to the cylinder head 13F with bolts 80 . . . . The compressed air, ejected from the air compressor 42, is introduced into the regulator 79, and the regulator 79 adjusts the pressure of the compressed air. The compressed air thus adjusted is led through an air supply pipe 78. A first end of the air supply pipe 78 is hermetically connected to the regulator 79. The second end of the air supply pipe 78 is connected to the injector holder 64 allowing the pipe 78 and the pressurized air route 77 to communicate with each other hermetically.

The fuel supply structure in the rear bank BR shares the air compressor 42 with the fuel supply structure in the front bank BF. Except for this feature, the structure in the rear bank BR is the same as that in the front bank BF. Thus, no detail explanation will be given as to the structure in the rear bank BR.

Explanations will follow as to the advantageous effects of this embodiment. Each of the cylinder heads 13F and 13R is provided with the installation hole 45, in the middle of which an annular shoulder portion 45*c* is formed to face the exterior side. The air injector 44, which is inserted into the installation hole 45, is held between the annular shoulder portion 45*c* and the damper cover 46. The damper cover 46 is attached to each of the cylinder heads 13F and 13R. In addition, the first damper means 47, with a high vibration-damping property, is set between the annular shoulder portion 45*c* and the air injector 44. Moreover, the second damper means 48, with a high vibration-damping property, is set between the damper cover 46 and the air injector 44.

In this way, the air injector 44 is floatingly supported, by the first and the second damper means 47 and 48, between the damper cover 46 and either of the cylinder heads 13F or 13R. As a result, the damper means 47 and 48 can curb the vibration generated in the air injector 44 that may otherwise be emitted out from each of the cylinder heads 13F and 13R. With this configuration, the operation noise due to the vibration of the air injector 44 can be effectively reduced.

In addition, the first damper means 47 is formed by stacking the two vibration-damping members 49 and 50, each one of which has a vibration-damping property different from that of the other. In this embodiment, four damping washers 49 . . . made of a vibration-damping steel sheet, or of a vibration-damping alloy, and a wave washer 50 are stacked to constitute the first damper means 47. As a result, the first damper means 47 can have an excellent effect on the reduction of the operation noise. In addition, the temperature rise of the air injector 44 can be curbed by the first damper means 47, by effectively blocking the transfer of the heat from each of the cylinder heads 13F and 13R to the corresponding air injector 44 with the stacked damping washers 49 . . . and the wave washer 50.

Moreover, the second damper means 48 has the damper holder 56 and the damper member 57. The damper holder 56 is brought into contact with the air injector 44 from the exterior side of the installation hole 45. The damper cover 46 supports the damper holder 56 and allows the damper holder 56 to move sliding in the axial directions of the installation hole 45. The damper member 57, which is held by the damper holder 56, is set between the damper holder 56 and the damper cover 46. In addition, the collar 58 is attached to the damper cover 46 to guide the sliding movement of the damper holder 56 to the damper cover 46 in the axial directions of the installation hole 45. As a result, the collar 58 facilitates a smooth sliding movement of the damper holder 56 in the axial directions of the installation hole 45, and the damper member 57 has an improved vibration-absorbing performance. Thus, the operation noise can be reduced more effectively.

Furthermore, the second damper means 48 has the damper member 57, at least a part of which is made of a rubber. The spring force of the wave washer 50 of the first damper means 47 is set lower than the spring force of the rubber 59. With this configuration, the set load of the wave washer 50 can be adjusted by adjusting the thickness of the rubber 59. The wave washer 50, with its contraction, absorbs the return vibration generated when the air injector 44 returns to the annular shoulder portion 45*c* side of the installation hole 45. As a result, the vibration transmitted to the cylinder heads 13F and 13R can be effectively absorbed.

Further, the air injector 44 is slidably fitted into the injector holder 64. The rear end of the air injector 44 is in communication with the pressurized air chamber 75 formed in the injector holder 64, which is at the fixed position to each of the cylinder heads 13F and 13R. This configuration can make assembling operation easier. At the same time, while the injection operation of the air injector 44 changes the pressure in the pressurized air chamber 75, the noise thus produced can be reduced with this configuration.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A fuel injection valve installation structure of an engine, comprising:

an installation hole with an annular shoulder portion in the middle portion thereof being formed in an engine component member that constitutes a part of the engine;

a fuel injection valve inserted into the installation hole and being held between the annular shoulder portion and a supporting member attached to the engine component member;

first damper means, with a high vibration-damping property, being set between the annular shoulder portion and the fuel injection valve; and second damper means, with a high vibration-damping property, being set between the supporting member and the fuel injection valve, wherein:

the second damper means has a damper holder and a damper member;

the damper holder being brought into contact with the fuel injection valve from the exterior side of the installation hole, and being supported by the supporting member slidably in the axial directions of the installation hole;

the damper member being held by the damper holder, and being set between the damper holder and the supporting member; and a sliding member being attached to the supporting member for guiding the sliding movement of the damper holder, in the axial directions of the installation hole, against the supporting member.

2. The fuel injection valve installation structure of an engine according to claim 1, wherein the first damper means is formed by stacking two kinds of vibration-damping member, each one of which has a different vibration-damping property from that of the other.

3. The fuel injection valve installation structure of an engine according to claim 1, wherein at least a part of the second damper means is made of rubber; and the first damper means has a wave washer with a spring force being set to be lower than that of the rubber.

4. The fuel injection valve installation structure of an engine according to claim 1, wherein the fuel injection valve is an air injector slidably fitted into a valve-holding member, while the rear end of the fuel injection valve is in communication with a pressurized air chamber formed in the valve-holding member, which is located at a fixed position to the engine component member.

5. The fuel injection valve installation structure of an engine according to claim 2, wherein the fuel injection valve is an air injector slidably fitted into a valve-holding member, while the rear end of the fuel injection valve is in communication with a pressurized air chamber formed in the valve-holding member, which is located at a fixed position to the engine component member.

6. The fuel injection valve installation structure of an engine according to claim 3, wherein the fuel injection valve is an air injector slidably fitted into a valve-holding member, while the rear end of the fuel injection valve is in communication with a pressurized air chamber formed in the valve-holding member, which is located at a fixed position to the engine component member.

7. The fuel injection valve installation structure of engine according to claim 2, wherein the engine component member is a cylinder head.

8. The fuel injection valve installation structure of engine according to claim 1, wherein the first damper means includes a plurality of damper members each being stacked one upon another and each being formed of a different vibration-damping property from that of the other and at least a part of one damper member being formed of rubber and further including a wave washer stacked on said plurality of damper members, said wave washing exerts a spring force being set to be lower than that of the rubber.

9. A fuel injection valve installation structure for use with an engine, comprising:

an installation hole formed in an engine component member that constitutes a part of the engine;

an annular shoulder portion formed in substantially the middle portion of the installation hole;

a support member operatively attached to the engine component member;

a fuel injection valve adapted to be inserted into the installation hole and being held between the annular shoulder portion and the supporting member attached to the engine component member;

first damper means, with a high vibration-damping property, being operatively positioned between the annular shoulder portion and the fuel injection valve; and second damper means, with a high vibration-damping property, being operatively positioned between the supporting member and the fuel injection valve, wherein the first damper means includes a plurality of damper members each being stacked one upon another and each being formed of a different vibration-damping property from that of the other and at least a part of one damper member being formed of rubber and further including a wave washer stacked on said plurality of damper members, said wave washing exerts a spring force being set to be lower than that of the rubber.

10. The fuel injection valve installation structure for use with an engine according to claim 9, wherein:

the second damper means has a damper holder and a damper member;

the damper holder being brought into contact with the fuel injection valve from the exterior side of the installation hole, and being supported by the supporting member slidably in the axial directions of the installation hole;

the damper member being held by the damper holder, and being set between the damper holder and the supporting member; and a sliding member being attached to the supporting member for guiding the sliding movement of the damper holder, in the axial directions of the installation hole, against the supporting member.

11. The fuel injection valve installation structure for use with an engine according to claim 9, wherein the first damper means is formed by stacking two kinds of vibration-damping member, each one of which has a different vibration-damping property from that of the other.

12. The fuel injection valve installation structure for use with an engine according to claim 10, wherein at least a part of the second damper means is made of rubber; and the first damper means has a wave washer with a spring force being set to be lower than that of the rubber.

13. The fuel injection valve installation structure for use with an engine according to claim 9, wherein the fuel injection valve is an air injector slidably fitted into a valve-holding member, while the rear end of the fuel injection valve is in communication with a pressurized air chamber formed in the valve-holding member, which is located at a fixed position to the engine component member.

14. The fuel injection valve installation structure for use with an engine according to claim 10, wherein the fuel injection valve is an air injector slidably fitted into a valve-holding member, while the rear end of the fuel injection valve is in communication with a pressurized air chamber formed in the valve-holding member, which is located at a fixed position to the engine component member.

15. The fuel injection valve installation structure for use with an engine according to claim 11, wherein the fuel injection valve is an air injector slidably fitted into a valve-holding member, while the rear end of the fuel injection valve is in communication with a pressurized air chamber formed in the valve-holding member, which is located at a fixed position to the engine component member.

16. The fuel injection valve installation structure for use with an engine according to claim 12, wherein the fuel injection valve is an air injector slidably fitted into a valve-holding member, while the rear end of the fuel injection valve is in communication with a pressurized air chamber formed in the valve-holding member, which is located at a fixed position to the engine component member.

17. The fuel injection valve installation structure for use with engine according to claim 11, wherein the engine component member is a cylinder head.

18. A fuel injection valve installation structure of an engine, comprising:

an installation hole with an annular shoulder portion in the middle portion thereof being formed in an engine component member that constitutes a part of the engine;

a fuel injection valve inserted into the installation hole and being held between the annular shoulder portion and a supporting member attached to the engine component member;

first damper means, with a high vibration-damping property, being set between the annular shoulder portion and the fuel injection valve; and second damper means, with a high vibration-damping property, being set between the supporting member and the fuel injection valve, wherein the fuel injection valve is an air injector slidably fitted into a valve-holding member, while the rear end of the fuel injection valve is in communication with a pressurized air chamber formed in the valve-holding member, which is located at a fixed position to the engine component member.

19. The fuel injection valve installation structure for use with an engine according to claim 18, wherein:

the second damper means has a damper holder and a damper member;

the damper holder being brought into contact with the fuel injection valve from the exterior side of the installation hole, and being supported by the supporting member slidably in the axial directions of the installation hole;

the damper member being held by the damper holder, and being set between the damper holder and the supporting member; and a sliding member being attached to the supporting member for guiding the sliding movement of the damper holder, in the axial directions of the installation hole, against the supporting member.

20. The fuel injection valve installation structure for use with engine according to claim 18, wherein the first damper means includes a plurality of damper members each being stacked one upon another and each being formed of a different vibration-damping property from that of the other and at least a part of one damper member being formed of rubber and further including a wave washer stacked on said plurality of damper members, said wave washing exerts a spring force being set to be lower than that of the rubber.

* * * * *